US005558534A

United States Patent [19]

Sarkady et al.

[11] Patent Number: 5,558,534

[45] Date of Patent: Sep. 24, 1996

[54] SELF SACRIFICING LATCHING SYSTEM

[75] Inventors: Michael D. Sarkady, Crystal Lake, Ill.; Jason M. Reisinger, Carlisle, Pa.; William V. Pauza, Palmyra, Pa.; James R. Fetterolf, Sr., Mechanicsburg, Pa.; James E. Connell, Jr., Hershey, Pa.

[73] Assignee: The Whitaker Corporation, Wilmington, Del.

[21] Appl. No.: 344,038

[22] Filed: Nov. 22, 1994

Related U.S. Application Data

[63] Continuation-in-part of Ser. No. 269,423, Jun. 30, 1994, Pat. No. 5,449,298.

[51] Int. Cl.[6] ..... H01R 13/627

[52] U.S. Cl. ..... 439/352; 439/357

[58] Field of Search ..... 439/350, 351, 439/352, 353, 354, 355, 356, 357, 358

[56] References Cited

U.S. PATENT DOCUMENTS

| | | | |
|---|---|---|---|
| 2,760,174 | 8/1956 | Burtt et al. | 439/358 |
| 3,101,230 | 8/1963 | Bausch et al. | 439/357 |
| 3,149,897 | 9/1964 | Martineck | 439/357 |
| 4,698,717 | 10/1987 | Scheid | 439/371 |
| 4,726,783 | 2/1988 | Nakazawa et al. | 439/350 |
| 4,798,542 | 1/1989 | Asick et al. | 439/188 |
| 5,011,424 | 4/1991 | Simmons | 439/352 |
| 5,090,916 | 2/1992 | Magnier | 439/352 |
| 5,199,897 | 4/1993 | Hashiguchi | 439/357 |
| 5,295,854 | 3/1994 | Olson | 439/350 |
| 5,314,347 | 5/1994 | Colleran et al. | 439/350 |
| 5,334,041 | 8/1994 | Anbo et al. | 439/358 |
| 5,338,219 | 8/1994 | Hiramoto et al. | 439/350 |
| 5,383,794 | 1/1995 | Davis et al. | 439/352 |

*Primary Examiner*—Hien D. Vu

[57] ABSTRACT

A self-sacrificing latching system for a pair of intermatable electrical connectors, such as a plug and receptacle, which incorporates a mechanism for unlatching same by the application of a maximum predetermined separating force, such as may be the result of an accident to the plug and receptacle. A first electrical connector includes a pair of flexible arms projecting axially therefrom, where the free end includes a bifurcated portion, while the second electrical connector includes a forward ramp surface against which the flexible arms initially ride to effect mating of the connectors. Further, there is a rearward surface slightly angled, i.e. on the order of about 4° to 10°, from a base toward the ramp surface, and a metal spring arm mounted within the second electrical connector in close proximity to the base of the rearward surface. To effect unmating under a maximum predetermined separating force, the bifurcated end will deform or separate allowing the respective connectors to freely unmate.

17 Claims, 5 Drawing Sheets

SELF SACRIFICING LATCHING SYSTEM

RELATED APPLICATION

This application, directed to a self sacrificing latching system for a pair of intermatable electrical connectors, is a continuation-in-part of co-pending application, U.S. Ser. No. 08/269,423, filed Jun. 30, 1994, now U.S. Pat. No. 5,449,298 and assigned to the assignee hereof.

BACKGROUND OF THE INVENTION

This invention is directed to a sacrificial latching system for a pair of intermatable connectors, such as a receptacle and plug as may be used in a cellular phone system, where, through accident or inadvertence, a separation of the respective connectors may be accomplished without destroying the receptacle, for example, within which is found the intricate signal transmission mechanism. The present invention represents a cost-effective way to ensure the integrity of the receptacle by sacrificing the less costly component, the plug, for example.

Conventional connector latching systems, while effective to unmate the respective connectors by a deliberate action of the user, they are not effective where accidental unmating may occur. Such systems typically employ a pair of externally accessible, manually depressible, pivotal members to effect unmating of the connectors. Typically, by manually squeezing such members, the members are laterally moved allowing for the physical separation of the connectors, see U.S. Pat. No. 4,726,783.

U.S. Pat. No. 5,314,347, a more current patent, is another connector latching mechanism that requires operator activation. The mechanism thereof has the disadvantage that the connectors cannot be suitably separated until the operator or user activates the levers of the mechanism. However, there may be situations where separation is desirable without manually activating a latching mechanism. For example, excessive force applied deliberately or by accident, may cause damage or destruction of the connectors' internal mechanism before the latching mechanism is overcome. U.S. Pat. No. 5,199,897 teaches a locking mechanism for connectors, such as a plug and receptacle, that allows separation without manipulating the locking mechanism.

U.S. Pat. No. 5,295,854 teaches a passive latch system for matable connector housings. Each connector housings has at least one working surface depressed from the reference surface thereof to form part of a latching aperture while the other of the housings has at least one working surface raised from the reference surface thereof to form part of a latching projection. The working surface on one of the housings is sloped with respect to its reference surface, and the sloped working surface also is tapered in a direction that is generally parallel with respect to the latching direction.

U.S. Pat. No. 5,011,424, assigned to the assignee hereof, teaches a connector system where pulling on the mated connectors alone disengages one connector from the other. This is achieved by a connector system in which there is a connector having an inner body section and an outer housing section, the inner body section having two latch arms operatively hinged to the connector. The connector has forward of its hinge, a latch arm having latching surfaces at its forward end which latch the connector to a complementary connector. The connector has rearward of the hinge, rotatable actuation arms. The connector is characterized in that the rotatable actuation arms including on the ends, actuator sections having a forwardly directed surface, while the housing includes a rearwardly facing camming surface disposed proximate to the forwardly facing surface, and in that the housing is axially moveable relative to the inner body causing the camming surface to rotate the latch arms about the hinge, thereby unlatching the connector from the complementary connector.

The co-pending application, which for convenience will be discussed with reference to a plug and receptacle as the intermatable electrical connectors secured by the latching system thereof, represents a first approach to providing a latching system that allows inadvertent unmating of connectors without destroying the respective connectors. The system comprises a plug having a pair of flexible arms projecting axially therefrom, where the free ends of the arms include slot means for engaging complementary arms within the receptacle. The receptacle includes a forward ramp surface against which the flexible arms initially ride to effect mating of the plug and receptacle, a rearward surface slightly angled from a base toward the ramp surface, and a metal spring arm mounted within the receptacle in close proximity to the base of the rearward surface. In the mated condition the spring arm engages the slot means, where the angular relationship of the respective engaging arms is 90°. To effect a non deliberate unmating, such as by accident, a maximum predetermined separating force, when applied between the plug and receptacle, causes the spring arm to flex to a position near the rearward surface at a critical release angle to thereby release the free end from its respective spring arm.

The present invention avoids the complexities of the latching mechanisms of the prior art by a simple, yet precise system, that allows for the separation of a pair of mated connectors, at a predetermined level of separating force applied thereto, through the sacrifice of a latching element thereof. The manner by which this is accomplished will become apparent from the further description, particularly when read in conjunction with the accompanying drawings.

SUMMARY OF THE INVENTION

This invention relates to a self sacrificing latching system for a pair of intermatable electrical connectors, such as a plug and receptacle, which incorporates a mechanism for unlatching same by the application of a maximum predetermined separating force, such as may be the result of an accident, to the plug and receptacle. The invention represents an improvement to the latching mechanism of said copending application, or an alternate approach to allow unmating of such connector through inadvertence. The system comprises a first electrical connector having a pair of flexible arms projecting axially therefrom, where the free ends of each arm includes an opening having a through slot extending therefrom to the outer edge of the arm, where said opening is intended to engage a complementary arm within the second electrical connector. While a manually operated mechanism may be provided to effect a planned unmating, the present invention provides a self sacrificing latching arm to prevent damage due to forces being applied thereto. For example, to effect unmating a maximum predetermined separating force will be exerted therebetween. By the design of the latching arm, particularly its free or engaging end, the bifurcated or slotted end will deform or separate allowing the respective connectors to freely unmate.

DETAILED DESCRIPTION OF PREFERRED EMBODIMENT

Figure 1:
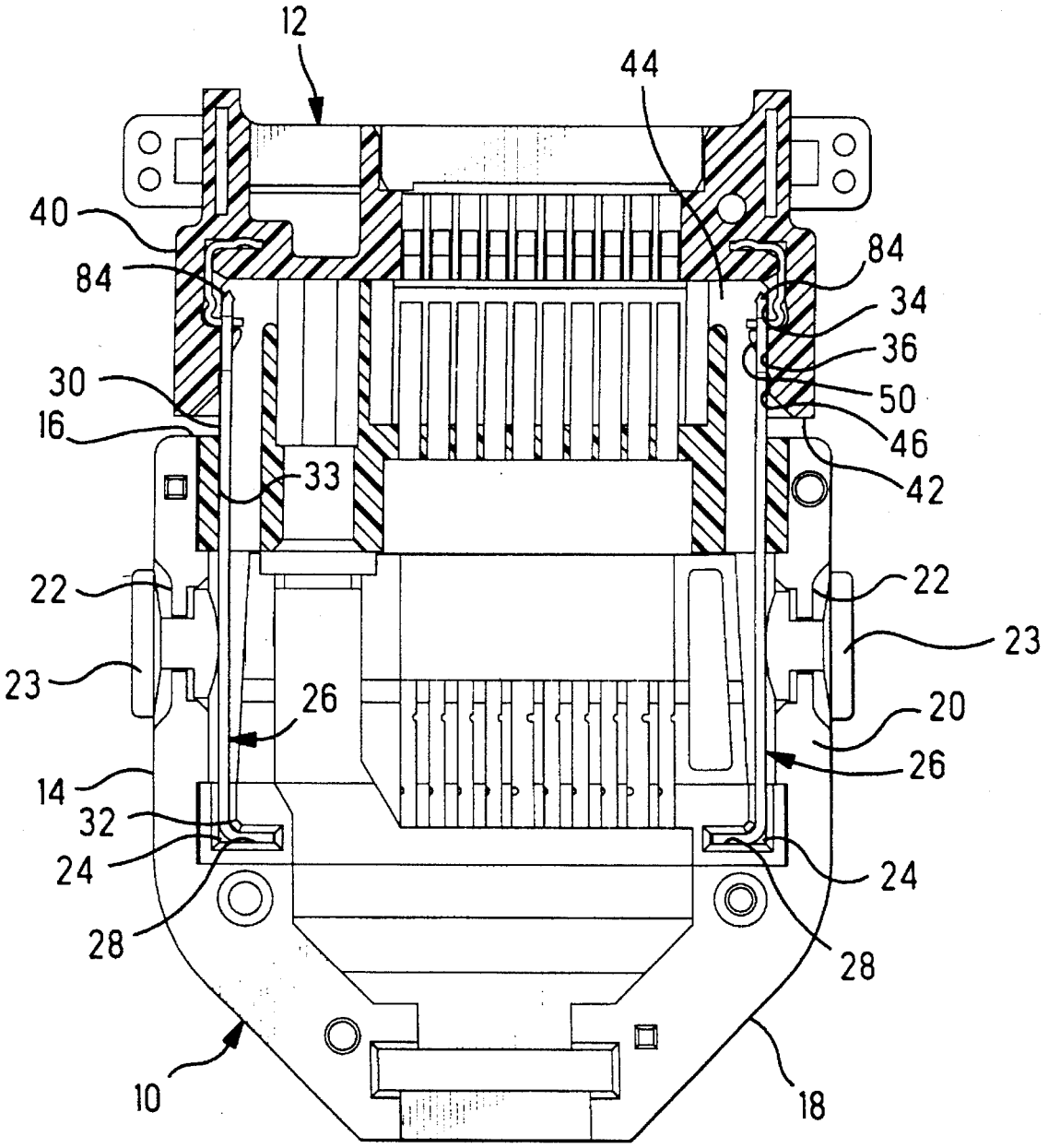
FIG. 1 is a full horizontal sectional view through a pair of exemplary mated electrical connectors, such as a plug and receptacle, utilizing the self sacrificing latching system of this invention, but showing its use with the invention of the co-pending application.

The present invention is directed to a unique latching system for a pair of intermatable electrical connectors, such as a receptacle and plug for a cellular phone, where separation of the plug from the receptacle may be accomplished manually, or by the application of a predetermined separating force applied therebetween, such as may be experienced with an accident. This invention represents an improvement to, or an alternative to, the latching system of the co-pending application, which application is incorporated herein by reference in its entirety.

In electrical systems of the type contemplated herein, it can be desirable to ensure a latching system that is operable to maintain electrical or signal contact, while being able to release upon the application of a predetermined pulling force, whether deliberate or by accident, to avoid damage to the contacts or other internal mechanism of the connectors.

For an explanation of the latching system hereof, reference may be made to the several Figures, a preferred embodiment of the invention being illustrated in a horizontal section of two mated electrical connectors, such as a plug 10 and a receptacle 12. While the preferred invention hereof is for a cellular telephone system, it will be understood that other matable connectors may likewise utilize the latching system as defined hereinafter. For convenience, and without intending to limit the scope of this invention, the further description will be directed to the intermating of a receptacle and plug for a cellular telephone system. The plug 10, the less expensive connector and therefore the one which may be sacrificed to avoid damage to the other connector, receptacle 12, comprises a generally rectangular body portion 14, formed of a dielectric material, such as plastic, having a mating face 16 at one end thereof, and a tapered body portion 18 through which plural conductors, electrical and/or signal, are passed to be terminated to contacts therein, as known in the art. For stability and design integrity, the side walls 20 are relatively thick and may include external depressions 22 for access to a pair of operator activated buttons 23 to effect a planned unmating thereof in a manner to be described hereinafter.

Internally, a pair of L-shaped slots or grooves 24 are provided to receive an elongated metal latching arm 26, where said arm is secured by press fitting the short extension 28 in slot 24. The long remaining arm portions 30, which extend in an axial direction through the mating face and into the receptacle 10, are free to flex or pivot about the junction 32 of the extension 28 and arm portion 30. While a number of metals may be used for the latching arm 26, a preferred metal is a Type 301 stainless steel, tempered to a ¾ hardness. Further, to ensure a proper flexion action, the latching arm 26, typically stamped from a flat metal blank, is initially formed a slight amount, i.e. about 4°, along a transverse line near the junction 32 so that in the assembled position the arm 26 lies against the housing wall 33. Finally, at the free end 34 of the arm portion 30 there is provided an elongated opening 36, the function and design details of which will become apparent hereinafter, particularly as illustrated in FIG. 5.

Figure 4:
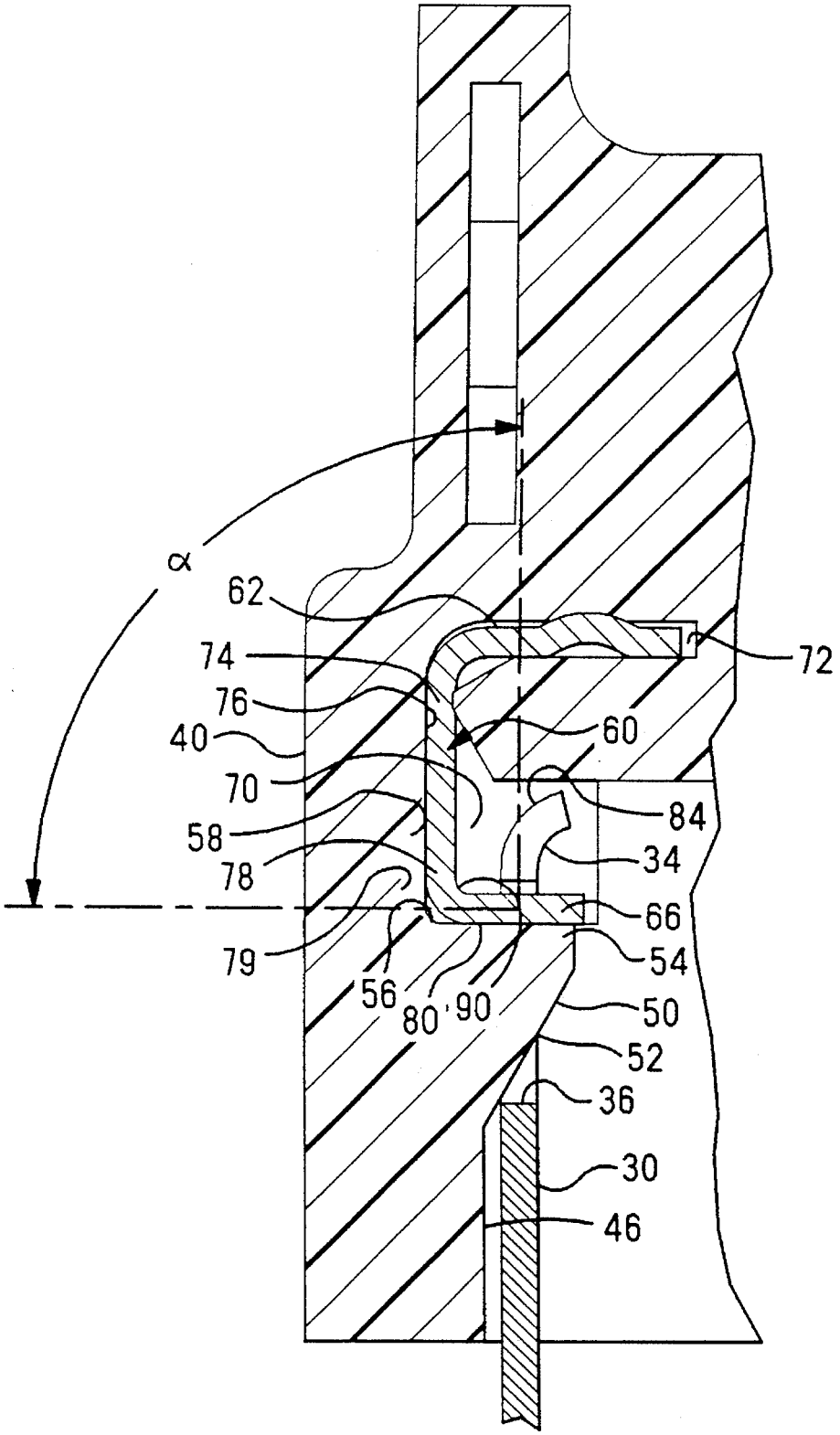
FIG. 4 is a partial, enlarged sectional view of one of a pair of latching members incorporating the self sacrificing latching system of this invention.
Figure 5:
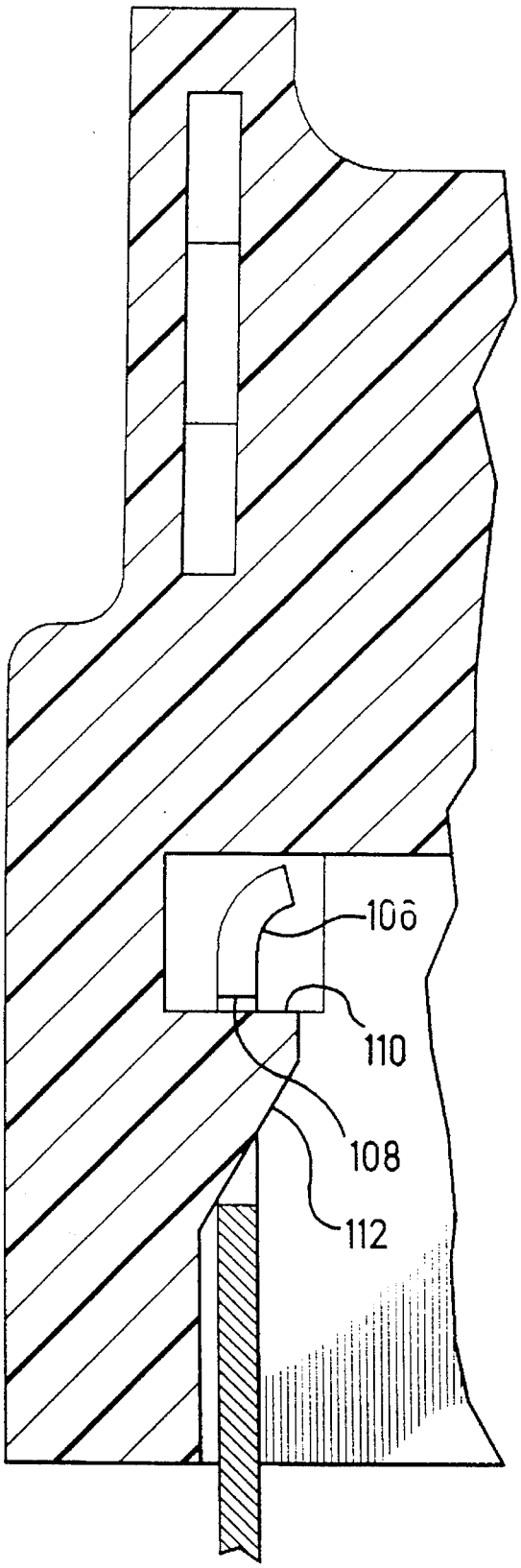
FIG. 5 is a partial, enlarged sectional view similar to FIG. 4, showing the use of the self sacrificing latching system of this invention, independent of the full latching details of the co-pending application.

Before detailing the features or design parameters of the complementary connector, or receptacle 12, it will be apparent from the several Figures, note particularly FIGS. 4 and 5, that while the latching principles are the same, there are different approaches that may be utilized in a final latching system. By way of further reference to FIG. 4 and 5, FIG. 4 illustrates the invention hereof as an improvement or back-up support to the latching system of the co-pending application, whereas FIG. 5 illustrates the invention as a true self sacrificing system.

Turning now to a discussion of the first embodiment, the complementary connector, or receptacle 12 of the first embodiment, comprises a housing 40, typically molded of a dielectric material, such as plastic, having a mating face 42, a through cavity 44, and related electrical hardware, such as electrical/signal contacts and an antenna connection, as known in the art. Along each side wall 46, facing the cavity 44, is an angled projection 50, see FIG. 4. The projection 50 includes a forward ramp surface 52 against which the arm portion 30 rides upon mating of the connectors. Rearwardly of the projection 50 is a slightly angled wall or surface 54, preferably angled from 4° to 10° from the plane of the longitudinal axis, which surface, as noted later, functions as a stop to the spring arm 60. At the base 56 of the angled surface 54, a recess 58 is provided. This recess, as will become apparent in the further description, provides relief in the flexing of the metal spring arm 60, as hereinafter defined.

Figure 2:
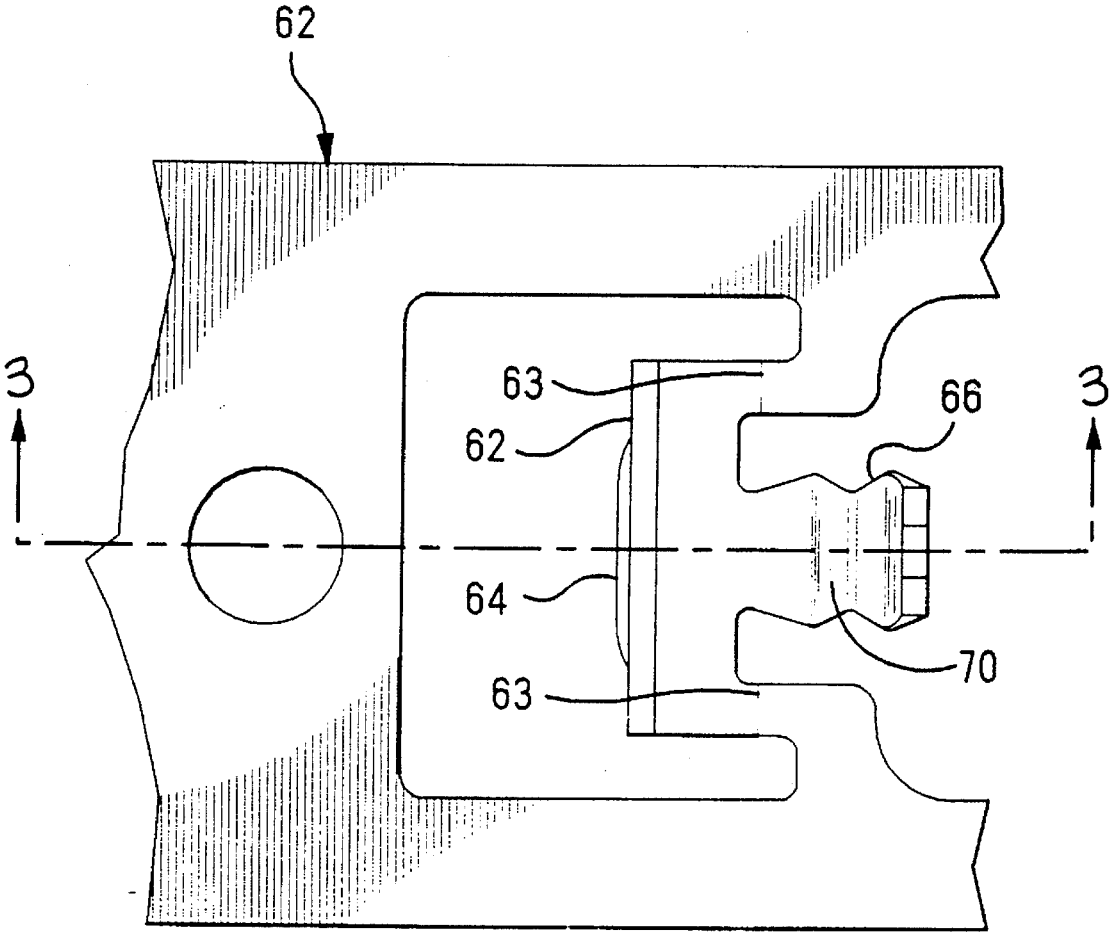
FIG. 2 is a plan view of a stamped and formed metal spring arm to be mounted in the receptacle, for example, where such metal spring arm is still joined to a removable carrier strip.
Figure 3:
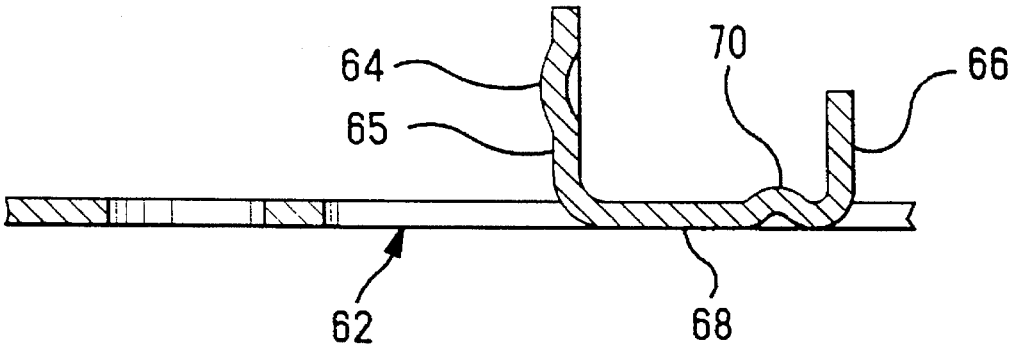
FIG. 3 is a sectional view taken along line 3—3 of FIG. 2.

The metal spring arm 60, formed of a tempered metal, such as beryllium-copper, is stamped and formed from a sheet metal blank 62 (see FIG. 2), preferably into the U-shaped configuration illustrated in FIG. 3, then severed along the cut lines 63 from the carrier strip. While a number of metals may be suitable, a preferred alloy is Berylco Alloy No. 25 (UNS No. C17200) manufactured by NGK Metals Corporation, Reading, Pa. The spring arm 60 is stamped from tempered sheet stock, formed and heat-treated to ¼ HT. In any case, the metal spring arm 60 includes a first leg 65, having an internal reverse bend portion 64, a second leg 66, narrower in width to first leg 65, and intermediate leg 68 joining the respective outer legs 65, 66. The intermediate leg 68 is also provided with a reverse bend portion 70, where such portion is positioned to lie adjacent the recess 58, for reasons to be explained.

The receptacle 12, as best seen in FIG. 4, includes a lateral slot 72 of a length to receive, by press fitting, the first leg 65 of spring arm 60. With the spring arm 60 suitably received in slot 72, it will be noted that the upper portion 74 of intermediate leg 68 lies adjacent to wall 76, while the lower portion 78 is spaced from the wall 79 of recess 58. Note further that in a resiled condition, the second leg 66 projects laterally, i.e. right angle to the plane of the axis of the mated connectors, and preferably is spaced, even at the base 80, from the angled surface 54.

Figure 6:
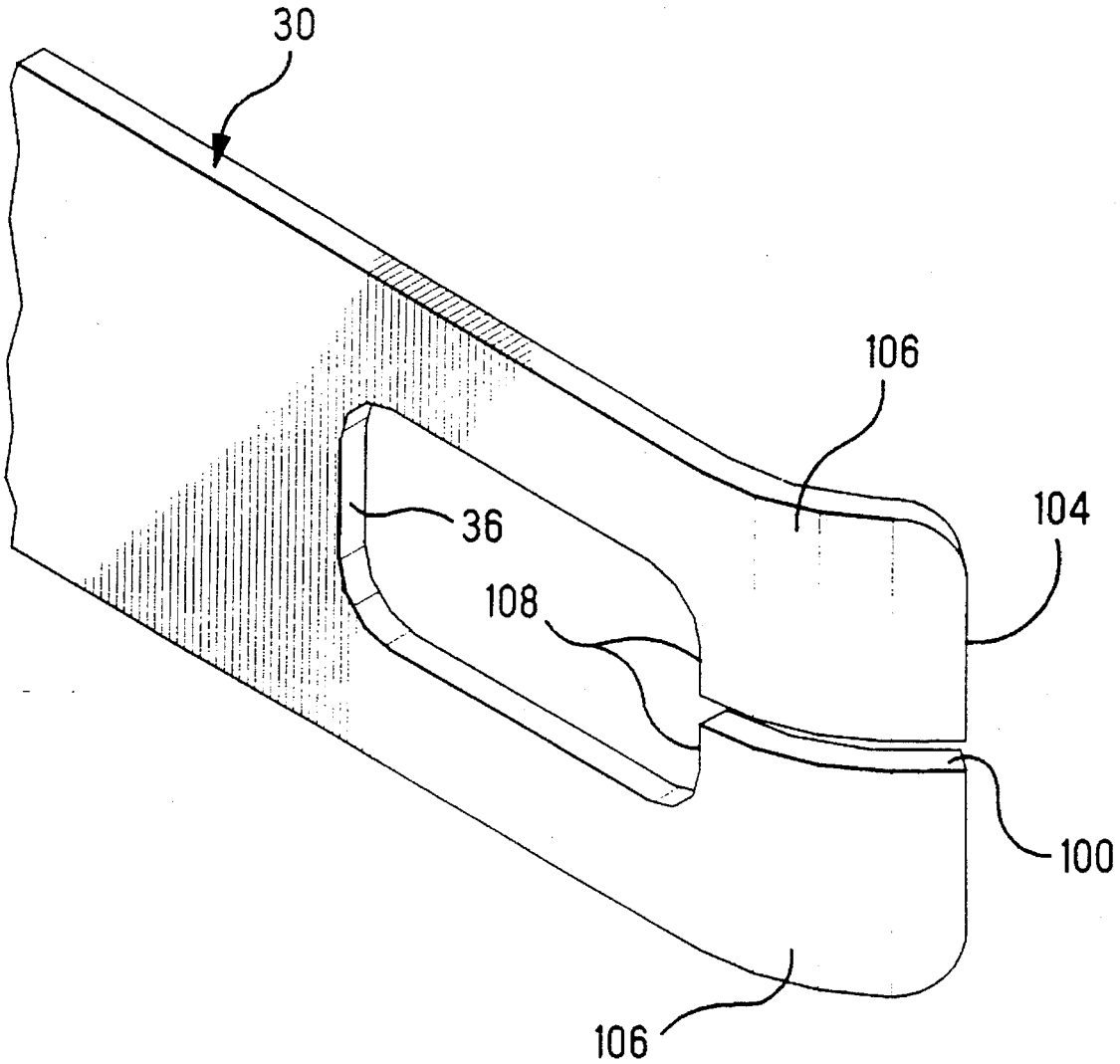
FIG. 6 is partial plan view of a metal latching arm, to be mated with the metal spring arm or ramp of FIGS. 4 or 5, illustrating the split or bifurcated end thereof.

Turning now to FIG. 6, for a better understanding of the function and design of the free end 34 of the arm portion 30, it will be seen that such free end includes an elongated opening 36, typically about 0.040 inches in width, with a slot 100 extending from the opening 36 to the edge 102 to define a split or bifurcated end 104. By the use of a narrow slot, preferably no more than about 0.005 inches in width, which is dimensionally less than the lateral dimension or width of the opening 36, the pair of fingers 106 are essentially L-shaped having a latching arm, pressure bearing surface 108. Dimensionally, a preferred embodiment for the free end 34 includes an essentially rectangular opening 36, about 0.040 by 0.070 inches, in an arm width of about 0.065 inches, where the length of the slot 100 is about 0.031 inches.

To mate the complementary connectors, the plug and receptacle, where the respective mating faces are in close proximity to one another, are coaxially pushed toward one another such that the latching arms 26 begin to ride up the ramp surfaces 52, along curved ends 84, where the arms flex inwardly. As the complementary connectors reach a fully mated position, the elongated opening 36 becomes exposed to the projection 50 and second leg 66 of the spring arm where it resiles to a latching position overriding the projection and leg, see FIG. 4.

In order to ensure repeatable and reliable mating and unmating thereof, it is important that flexing of the respective metal latching members be limited to a level below the plastic range of the metal, that is, below a level of permanent deformation. This has been achieved herein by the proper selection of the metal for the spring members, but more importantly by the design thereof.

To effect a deliberate unmating of the connectors, the opposed buttons 23 may be manually squeezed to deflect inwardly the respective latching arms 60 and thereby free them from the leg 66. However, a significant feature of this invention is the ability or freedom to inadvertently unmate the plug and receptacle without adversely affecting the receptacle. The maximum separating force is required when the separation is along a coaxial direction. However, an accidental angular force may be applied to the connectors, and this force would likely be less than the design maximum. Continuing now with the unmating, the invention of the copending application is designed to have the free end 34 slide inwardly along the leg portion 66 toward the angled surface 54. However, since accidents are normally unplanned, a backup or failproof system may be desirable considering the alternative of potential damage to the receptacle 12. The present invention provides such a backup system. By the use of the bifurcated end 104, with the force of unmating against the surfaces 108, it will be understood that as such force reaches a preset level it begins to separate and/or deform the opposing fingers 106 and allow the arm portion 30 to override and be released from arm portion 66 and projection 50. Even if such deformation is permanent, thereby necessitating a replacement of the plug, the alternative of replacing the entire mechanism is avoided.

The foregoing, namely the features embodied in FIGS. 1–5, represents a preferred approach to providing a releasable or unmatable connector system, by the utilization of the latching system of said co-pending application and the sacrificial system hereof. With regard to this preferred approach, there are a number of factors that can influence the final design parameters for such a system. As taught in the copending application, the release angle, typically in the range of 4° to 10°, is totally dependent upon the coefficient of friction of the respective metal members, and surface roughness due to fabrication, such as in forming and shearing. Further, the predetermined force is dependent upon the geometry and material of the metal members. However, what can be stated, particularly with regard to FIGS. 1 and 5, the length of the latching arm 60 is relatively long compared to its distance of travel to the position of being released. That is, in the static position illustrated in FIG. 4, the angle $\propto$ is 90°. As the latching arm 60 begins to pull the leg segment 66 downwardly, the angle $\propto$ becomes less than 90°. Were the angle greater than 90°, such as might be found with a relatively short latching arm, the dynamic forces would tend to hold the latching arm rather than allowing it to slide and release.

Finally, with all the above factors considered, it is to be further understood that there is a relationship between the separating force and the critical angle. It was discovered that for a separating force of about 5 pounds per latch, with the design criteria and preferred material used, the critical angle was 5°, relative to a plane traverse to the connector axis, and that the angle $\propto$ was 87.5°. A further factor, which has particular relevance herein, is that the respective metal latching arms 26, 60, when stamped and formed, may reveal burrs or sharp edges. This can effect the sliding movement of the respective arms on one another and thereby hinder a separation at the desired separation force. Rather than exceeding such force, the self sacrificing nature of arm 26 can ensure unmating without damage to the receptacle.

Considering finally FIG. 6, which teaches a self sacrificing latching system, many of the concerns expressed above may be avoided. While the system of FIG. 6 will not ensure repeated mating and unmating, it offers a positive approach to protecting the intricate mechanism of the receptacle, for example, where such protection is a vital concern. The differences in the two approaches may be seen in a comparison of FIGS. 4 and 6. For example, the spring member of the receptacle may be optionally excluded, or at best simplified by the addition of a laterally extending metal arm to protect the lateral surface 110 of ramp 112. The surface 110, with or without protective support, is the pressure bearing surface against the surfaces 108 of the bifurcated members or fingers 106. Accordingly, there is no need, as in the case of the embodiment of FIGS. 1–4, to angle the surface 110. A preferred design or orientation for the surfaces 108 is horizontal to the arm edges. This helps ensure better control on the pull out force by giving an abrupt failure to the latching system. If the surfaces 108 are tapered or converge toward the slot 100, the release will be slow by the gradual separation of the fingers 106.

We claim:

1. An electrical connector having a latching system to maintain a latched relationship with a complementary electrical connector where said connectors are in latching relationship during periods of operability, and may be unlatched by exerting a maximum predetermined separating force on the respective connectors, said latching system comprising a pair of flexible metal arms disposed along opposite sides of the electrical connector, where free ends of said metal arms each includes an opening of a size to be received on one of complementary members of the complementary connector, each of said free ends further characterized by a small slot extending from said opening to an outer edge of the respective arm defines a pair of complementary fingers, said complementary electrical connector including a forward ramp surface against which said flexible arms initially ride to effect mating of said connectors, and a rear, laterally disposed surface, so that in the mated condition said complementary member engages said opening, whereby applying the maximum predetermined separating force between the electrical connectors causes a localized force on said fingers, to spread said fingers and free said openings from said complementary members, thereby releasing the connectors from each other.

2. The latching system according to claim 1 wherein said slot is at an end of said flexible metal arms and between said fingers.

3. The latching system according to claim 2 wherein a distance between the fingers is smaller in an area of the slot than a distance between the fingers in an area of the opening.

4. The latching system according to claim 3 wherein said fingers are L-shaped.

5. The latching system according to claim 1, wherein a pair of opposing operating members, each operating on the respective flexible arm, to effect manual disengagement of said electrical connectors.

6. The latching system according to claim 1 wherein a metal support member of the complementary connector is provided adjacent to said rear laterally disposed surface.

7. An electrical connector having a latching system to maintain a latched relationship with a complementary electrical connector where said connectors are in latching relationship during periods of operability, and may be unlatched by exerting a maximum predetermined separating force on the respective connectors, said system comprising a pair of flexible metal arms disposed along opposite sides of the electrical connector and having free ends proximate a mating end of said electrical connector, where the free ends of said metal arms each includes an opening of a size to be received on one of a complementary members within said complementary electrical connector, each of said free ends further characterized by a small slot extending from said opening to an outer edge of the respective flexible metal arm to define a pair of complementary fingers, each of said complementary members including a forward ramp surface against which said respective flexible metal arm initially rides to effect mating of said electrical connectors, a slightly angled wall opposite said ramp surface, and a metal spring arm mounted within said complementary electrical connector in close proximity to said slightly angled wall and in engagement with the respective opening of each of said flexible metal arm, whereby applying the maximum predetermined separating force between the electrical connectors causes a localized force on said fingers, to spread fingers and free said openings from said complementary members, thereby releasing the connectors from each other.

8. The latching system according to claim 7 wherein said slot is at an end of said flexible metal arms and between said fingers.

9. The electrical connector having a latching system according to claim 8 wherein a distance between the fingers is smaller in an area of the slot than a distance between the fingers in an area of the opening.

10. The latching system according to claim 9 wherein said fingers are L-shaped.

11. The latching system according to claim 7, wherein a pair of opposing operating members, each operating on the respective flexible arm, to effect manual disengagement of said electrical connectors.

12. An electrical connector having a latching system to maintain a latched relationship with a complementary electrical connector having a pair of projections, each of the projections having a forwardly facing ramp surface and a rearwardly facing shoulder, the latching system comprising:

a pair of flexible cantilevered metal latching arms disposed along opposite sides of the electrical connector, the latching arms being secured to the electrical connector and having free ends which are latchable with projections of the complementary electrical connector, each of said latching arms having a pair of fingers disposed at each of the free ends to define an opening therebetween and a small slot extending from the opening to an outer edge of the latching arm, the fingers of each of the latching arm being profiled to spread and release from the respective projections of the complementary connector when a pulling force greater than a predetermined pulling force is applied opposite a mating direction between the connectors releasing them from each other.

13. The latching system according to claim 12 wherein said slot is at an end of said flexible metal arms and between said fingers.

14. The latching system according to claim 13 wherein a distance between the fingers is smaller in an area of the slot than a distance between the fingers in an area of the opening.

15. The latching system according to claim 14 wherein said finger are L-shaped.

16. The latching system according to claim 12, wherein a pair of opposing operating members, each operating on the respective flexible arm to effect manual disengagement of said electrical connectors.

17. The latching system according to claim 12 wherein a metal support member of the complementary connector is provided adjacent to said rear laterally disposed surface.

* * * * *